United States Patent [19]

Schönert et al.

[11] Patent Number: 4,941,969

[45] Date of Patent: Jul. 17, 1990

[54] METHOD OF AND AN APPARATUS FOR THE SEPARATION OF PARAMAGNETIC PARTICLES IN THE FINE AND FINEST PARTICLE SIZE RANGES IN A HIGH-INTENSITY MAGNETIC FIELD

[75] Inventors: Klaus Schönert, Tannenhöhe 4, 3392 Clausthal-Zellerfeld; Hans-Michael Fricke, Limburgerhof, both of Fed. Rep. of Germany

[73] Assignee: Klaus Schönert, Clausthal-Zellerfeld, Fed. Rep. of Germany

[21] Appl. No.: 146,811

[22] PCT Filed: Mar. 25, 1987

[86] PCT No.: PCT/DE87/00128

§ 371 Date: Jan. 25, 1988

§ 102(e) Date: Jan. 25, 1988

[87] PCT Pub. No.: WO87/05829

PCT Pub. Date: Oct. 8, 1987

[30] Foreign Application Priority Data

Mar. 26, 1986 [DE] Fed. Rep. of Germany ..... 3610303

[51] Int. Cl.[5] ..... B03C 1/00

[52] U.S. Cl. ..... 209/39; 209/212; 209/232

[58] Field of Search ..... 209/39, 40, 212, 213, 209/214, 232, 478, 223.1, 225, 228; 210/222, 223, 695

[56] References Cited

U.S. PATENT DOCUMENTS

| | | | |
|---|---|---|---|
| 1,056,318 | 3/1913 | Bruck | 209/232 |
| 3,966,590 | 6/1976 | Boom et al. | 209/232 X |
| 4,102,780 | 7/1978 | Sun et al. | 209/213 X |
| 4,235,710 | 11/1980 | Sun | 209/213 |
| 4,261,815 | 4/1981 | Kelland | 209/213 |
| 4,663,029 | 5/1987 | Kelland et al. | 209/232 X |

FOREIGN PATENT DOCUMENTS

| | | | |
|---|---|---|---|
| 2461760 | 7/1976 | Fed. Rep. of Germany . | |
| 2317013 | 2/1977 | France . | |
| 0275912 | 10/1970 | U.S.S.R. | 209/39 |
| 1338894 | 9/1987 | U.S.S.R. | 209/478 |

OTHER PUBLICATIONS

M. Takayasu et al, "Continuous Selective HGMS . . . ", *IEEE Transactions on Magnetics,* vol. MAG-20, No. 5, Sep. 1984, pp. 1186-1188.

Y. M. Eyssa et al, "Flow-through Magnetic . . . ", *IEEE Transactions on Magnetics,* vol. MAG-11, No. 5, Sep. 1975, pp. 1585-1587.

*Primary Examiner*—Margaret A. Focarino

*Assistant Examiner*—Edward M. Wacyra

[57] ABSTRACT

An apparatus and a method of effecting the separation of paramagnetic particles from non-paramagnetic particles in the fine and finest particle size ranges of approximately below 1 mm suspended in a fluid medium by the passage of the fluid medium through an apparatus having a separation channel suitable for containing a flow of the fluid medium flowing therethrough and which includes at least two exits suitable for separating the paramagnetic particle enriched fluid medium from the paramagnetic particles depleted fluid medium into two product streams, the separation channel defining the direction of the fluid medium flow being at least partially paralleledly oriented with respect to a magnetic induction member such that the magnetic flux exerted upon the paramagnetic particles within the fluid medium flow are repulsed from the induction member and entrained within the fluid medium to countereffect the effect of inertial forces or gravitational forces on the fluid flow, and separated from the non-paramagnetic particles within the fluid medium flow which succumb to the effect of the inertial forces of gravitational forces and are separated from the paramagnetic particles within the fluid medium flow. In a preferred embodiment of the invention, the induction members are oriented below their associated separation channels at right angles with respect to the lines of magnetic flux, and the separation channels are inclined with respect to the horizontal, so that gravitational forces acting upon the paramagnetic particles contained within the fluid medium are countereffected by the repulsive forces exerted on the same paramagnetic particles by the induction members.

15 Claims, 7 Drawing Sheets

Figures 1, 1A:
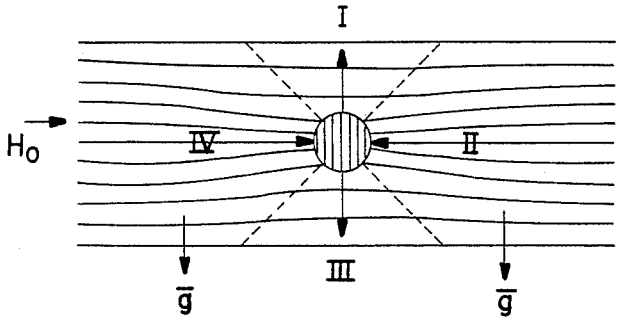

METHOD OF AND AN APPARATUS FOR THE SEPARATION OF PARAMAGNETIC PARTICLES IN THE FINE AND FINEST PARTICLE SIZE RANGES IN A HIGH-INTENSITY MAGNETIC FIELD

High-intensity magnetic separators are used for separating paramagnetic minerals in the fine particle size range below approximately 1 mm. In a magnet arrangement of such separators ferromagnetic induction members are provided in a homogeneous magnetic field generated by the magnets thereof so as to cause distortion of the field. The placement of ferromagnetic induction members within a homogeneous magnetic field creates a magnetic flux gradient possessing regions of intensified magnetic flux density and regions of depleted magnetic flux density. The resultant forces of either attraction or repulsion are generated by the composition of the particulate material flowing through such magnetic field gradient whereby a paramagnetic particulate material passing within the magnetic flux gradient will experience an induced magnetic field having the same polarity direction as the applied magnetizing field resulting in a repulsion force thereupon while a diamagnetic particulate material passing through the magnetic flux gradient will experience an induced magnetic field having the opposite polarity direction relative to the applied magnetizing field resulting in an attractive force thereupon. The respective resultant forces determine the relative displacement of the particulate material within the separating chamber. The material to be separated consisting of paramagnetic particles and non-magnetizable particles suspended in a liquid or gaseous carrier medium, usually water but perhaps also air, is passed through the magnetic field which is distorted along the induction members. The paramagnetic particles are deflected by the magnetic force of attraction to the induction bodies on which they deposit, while the other particles which are non-magnetizable follow the flow of the carrier medium, passing through the magnetic field. At a later time when the magnetic field is no longer effective, the particles accumulated on the induction members are flushed off and out so that the magnetic concentrate may be recovered. For this reason the magnetic separators in question also are referred to as hold-back separators.

The induction members may be embodied by profiled plates, balls, cylindrical bars, rods, or wires. The characteristic length of their topography, e.g. the diameter of the wires or the height of the profiles determines the degree of unhomogeneity of the magnetic field and this increases monotonously at decreasing dimensions. The magnetic force grows with the degree of unhomogeneity, is proportional to the susceptibility of the particles and to the particle volume, and rises as the distance from the induction member diminishes.

The fundamental structure of the hold-back separator necessitates discontinuous operation. In an industrial process, however, continuous operation is desirable. Special measures must be taken to realize that.

In the simplest case two or more magnetic separators are used with their separating cycles succeeding each other. The material to be separated is fed to the respective magnetic separator which operates in its separating cycle. Subsequently the magnet is turned off and the concentrate is rinsed out, while another magnetic separator is effecting separation with the magnetic field switched on. Another possibility provides for taking the pack of induction members out of the magnetic field and then clearing out the magnetic concentrate. A carrousel arrangement is especially well suited for this purpose because it constantly moves unloaded induction members into the magnetic field, while loaded ones are taken out. The most frequently used design of technical high-intensity magnetic field separators thus is a realization of the carrousel arrangement.

Likewise known are proposals to construct high-intensity magnetic separators according to the principle of the continuously operating crossflow separating apparatus. As in the case of the above mentioned hold-back separators, the paramagnetic particles are deflected by the attractive force to the induction members, in other words transversely of the conveying direction. However, they are not to accumulate there but instead be transported by the flowing medium along the induction members and be separated at the outlet of the or each separating channel by separator blades from the remaining flow which is loaded with the non-magnetizable particles. Such a crossflow high-intensity magnetic field separator theoretically has an advantage as compared to the magnetic separators which operate in cycles or the carrousel separators in that the magnetic field need not be switched off and on and the feed and product flows need not be switched over. The arrangement of the induction members remains stationary and the carrousel which is of complicated structure is dispensed with. However, it has the disadvantage that in adopting this proposal for an industrially useful separating apparatus, a problem is encountered in that the transportation of the particles, specifically the paramagnetic particles along the induction members is unsatisfactory or does not take place at all. This type of construction of crossflow high-intensity magnetic field separators is not at all successful in the fine particle size range.

It is an object of the instant invention to provide a method by which material containing paramagnetic particles in the fine particle size range below approximately 1 mm can be separated continuously in crossflow in a high-intensity magnetic field. It is another object of the invention to provide a method of the kind specified which will allow more efficient separation and sharper discrimination. Yet another object of the invention is to provide a method which permits sufficiently high throughput for industrial application.

Another object of the instant invention resides in devising an apparatus to carry out the method of continuous separation mentioned.

The flow of material to be separated, in accordance with one aspect of the invention, proceeds parallel to at least one induction member and, at the end of a separating path, it is divided into at least one product flow depleted of paramagnetic particles and one product flow enriched with paramagnetic particles. More specifically, the flow of material to be separated is passed parallel to each induction member in a magnetic field in which the repulsion force caused by each induction member is oriented with respect to the gravitational force, in the case of a static system, or the centrifugal force, in the case of a rotating system, such that the resulting force will propel the paramagnetic particles to be separated away from the induction member and the other particles towards the induction member, the flow of material being passed above each induction member in the gravitational field and on the inner side facing the axis of rotation of each induction member in the centrifugal field.

In accordance with another aspect of the invention the method of continuous separation specified is carried out by an apparatus in which an induction member each in the form of a wire of circular, elliptical, or rhomboid cross section is oriented at right angles with respect to the lines of flux of the magnet arrangement outside of each separating channel. Each separating channel which is approximately as long as the induction member is located directly above the induction member and has a width of approximately up to one time the diameter and a height of approximately one to two times the diameter of the induction member.

The novel magnetic separating process and the novel high-intensity magnetic field separator permit perfect technical separations in the particle size range between a few micrometers and a few millimeters at a magnetic susceptibility of the paramagnetic particles of between $10^{-5}$ and $10^{-2}$. The invention utilizes both the magnetic repulsion and the force due to inertia (gravity or centrifugal force) for separation. This repulsive force is directed antiparallel to the gravitational or centrifugal force.

Around each induction member areas are formed side by side with a concentration of the field causing attraction forces or a reduction of the field causing repulsion forces. Thus the field only a cylindrical induction member in the form of a bar or a wire of circular, elliptical, or rhomboid cross section has a four-radiate symmetry, as illustrated in FIGS. 1*a*-1, 1*a*-2 1*a*-3, respectively. The magnetic field of field intensity $H_o$ which as such is homogeneous is oriented in such manner that the lines of flux extend horizontally. The bar-or wire-shaped cylindrical induction members are disposed horizontally, yet at right angles with respect to the lines of flux. In this arrangement repulsive forces are generated in sectors I and III, while attractive forces result in sectors II and IV, the forces diminishing as the distance from the axis increases. In vertical direction above the wire the repulsion is directed antiparallel to gravity. There is a distance at which the repulsive and gravitational forces are of the same amount. At a given field and given wire diameter of the induction member it is only the susceptibility of the particles and not their size which determines this equilibrium spacing.

In a separating channel 2 disposed above an induction member 1 the particles assume positions at different levels in accordance with their susceptibility. Particles of zero susceptibility form sediments on the bottom of the separating channel due to gravity. In this manner paramagnetic particles 3 and non-magnetizable or unmagnetic particles 4 drift in opposite directions, as shown in FIG. 1*b*. Both types of particles thus can be separated with ease for the first time. If the separating channel 1 is sufficiently high, the paramagnetic particles do not touch the upper channel wall; their conveyance through the separating channel thus remains unobstructed.

Figures 1, 1A, 2:
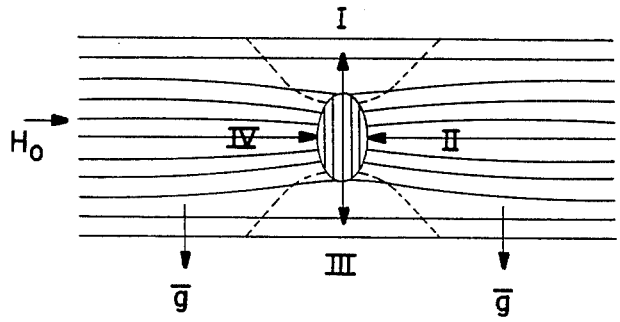
Figures 1, 1A, 2, 3:
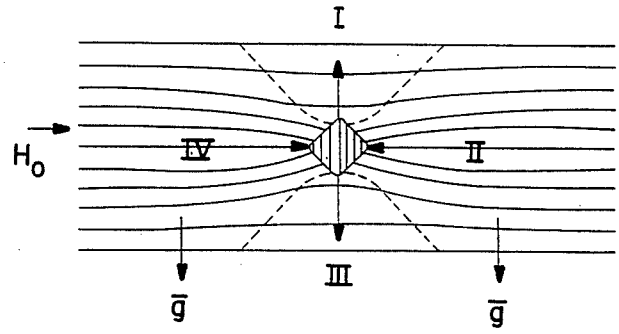
Figure 1B:
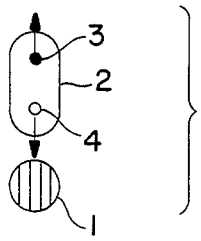
Figure 1C:
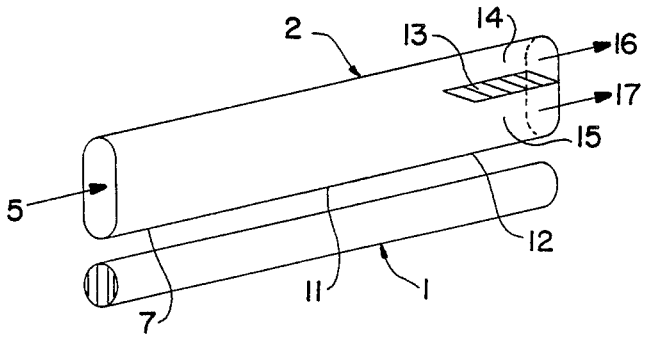

The material to be separated is dispersed in a fluid medium and supplied as a feed flow 5, as shown in FIG. 1*c*, to the inlet end 7 of separating channel 2 for separation along a downstream separating distance 11. At the outlet end 12 of separating channel 2 a separator blade 13 is provided which divides the separating channel into an upper outlet passage 14 and a lower outlet passage 15. An upper product flow 16 enriched with the paramagnetic particles and thus containing the magnetic concentrate issues from the upper outlet passage 14. A lower product flow 17 which is depleted of paramagnetic particles or contains the other particles, i.e. the unmagnetic particles leaves the lower outlet passage 15.

Figure 1D:
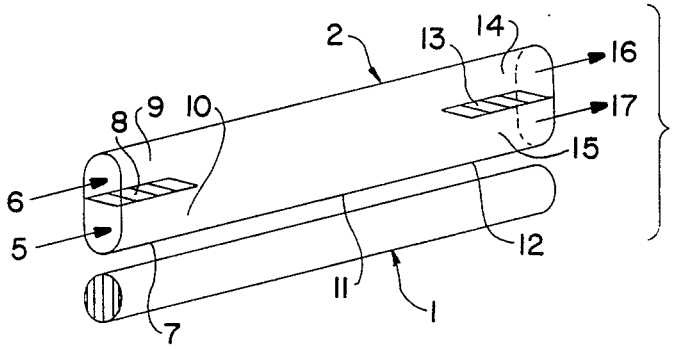

It is likewise possible to supply two streams separately and above each another to the separating channel 2, as may be seen in FIG. 1*d*. To accomplish that, a partition 8 is provided in the separating channel at the inlet end 7 so as to divide this end into an upper inlet passage 9 and a lower inlet passage 10. The feed flow 5 of material to be separated is fed into the lower inlet passage 10. A flow 6 of a preferably pure fluid medium, such as water is introduced into the upper inlet passage 9. The rate of flow through the channel is to be adjusted such that the time of residence in the separating distance 11 of the separating channel will be sufficient for all or at least most of the paramagnetic particles to drift across the height of the separator blade 13 provided at the outlet end.

To facilitate the conveyance of the lower layer of unmagnetic particles, the separating channel 2 and the induction member 1 preferably are inclined with respect to the horizontal at an angle of from 0° to 50°, preferably from 15° to 40° from the inlet to the outlet.

This method of magnetic separation for the first time permits continuous flow separation with good separation efficiency of fine granular paramagnetic substances from non-magnetic particles in the fine particle range. For instance, mixtures of hematite ($\alpha=3\cdot10^{-3}$) and quartz containing particles of between 10 and 100 μm could be separated so that less than 2% erroneous discharge occurred of hematite in the lower product flow, in other words in the unmagnetic flow or of quartz in the upper product flow, i.e. in the magnetic concentrate. The induction member used was a pure iron wire having a diameter of 3 mm and a length of 100 mm, the flux density was adjusted to 1.5 Tesla and the flow velocity to 8 cm/s. These results cannot be obtained with conventional carrousel-type magnetic separators.

Figure 2A:
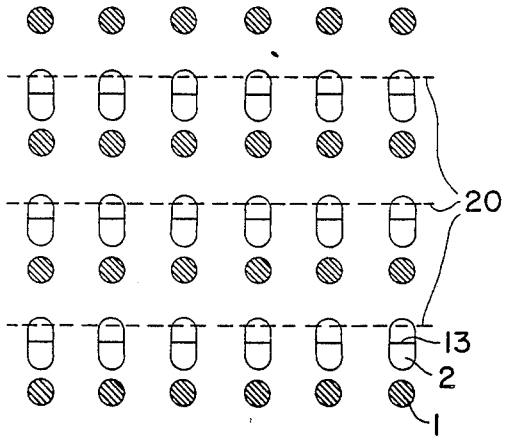
Figure 2B:
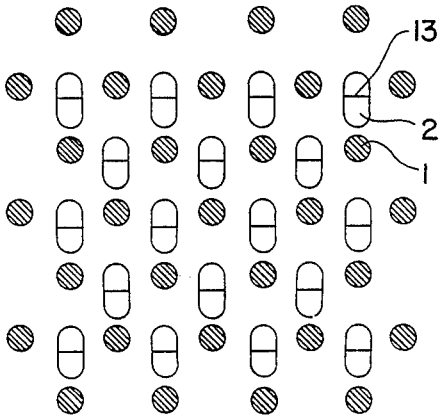

In an industrial high-intensity magnetic separator several induction members and corresponding separating channels were installed between the magnetic poles so as to be oriented alike in order to increase the flow rate and improve the utilization of the active volume between the magnetic poles. The induction members may be arranged such that the cross sectional pattern obtained is rectangular, as shown in FIG. 2*a* or a rhomboid as shown in FIG. 2*b*. In the first case the superpositioning of the magnetic fields produces areas 20 in which the effect of magnetic force disappears. The equilibrium height of the paramagnetic particles lies below these areas. If the upper wall of the separating channel is not located below area 20, the paramagnetic particles do not rise as far as the upper wall so that their conveyance through the separating channel is not obstructed by any friction or adhesion. The separator blade 13 must be located below the equilibrium level. In the second case, the induction members arranged laterally of the separating channel have the effect that, above a certain level, the magnetic force which is directed upwardly will rise again from a minimum value up to a maximum value at the level of the connecting line between the centers of the induction members, in order to drop subsequently to zero. This curve of force between the peaks of the minimum and maximum provides a layer which is free of particles so that the flow which is enriched with the paramagnetic particles can be separated more easily than before from the flow which is depleted of paramagnetic particles.

The magnetic field may be generated by permanent magnets, electromagnets, or by superconductive coils. The Opposed directions of drift of paramagnetic and unmagnetic particles require an inertia force which is directed against the magnetic repulsive force. In the case of straight, stationary separating channels this is the gravitational force. However, it is possible also to make use of the centrifugal force if the induction members and the separating channels are provided concentrically or spirally with respect to the axis of rotation of a rotating system or if stationary induction members and separating channels have a curved configuration so that centrifugal forces are generated as a flow passes through them.

The high-intensity magnetic repulsion separator according to the invention may take different embodiments, depending on the selection of the magnetic system and the inertia force. Four advantageous embodiments will be described further below with reference to diagrammatic drawings, in which:

FIG. 1*a*-1 is a drawing illustrating an embodiment of the induction member having a circular cross-section according to the invention.

FIG. 1*a*-2 is a drawing illustrating an embodiment of the induction member having an elliptical cross-section according to the invention.

FIG. 1*a*-3 is a drawing illustrating an embodiment of the induction member having a rhomboidal cross-section according to the invention.

FIG. 1*b* illustrates the cross-section of a separation channel disposed above an induction member.

FIG. 1*c* illustrates a separation channel having a separator blade disposed at the exit region for separating the flow of the fluid medium into two streams, an upper stream containing the paramagnetic particles from the lower stream containing the non-paramagnetic particles.

FIG. 1*d* illustrates a separation channel according to FIG. 1*c*, and further includes a partition for separating the inlet of the separation channel to allow the input of two fluid medium streams.

Figure 3B:
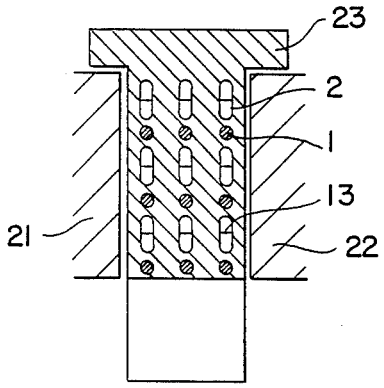
Figure 3A:
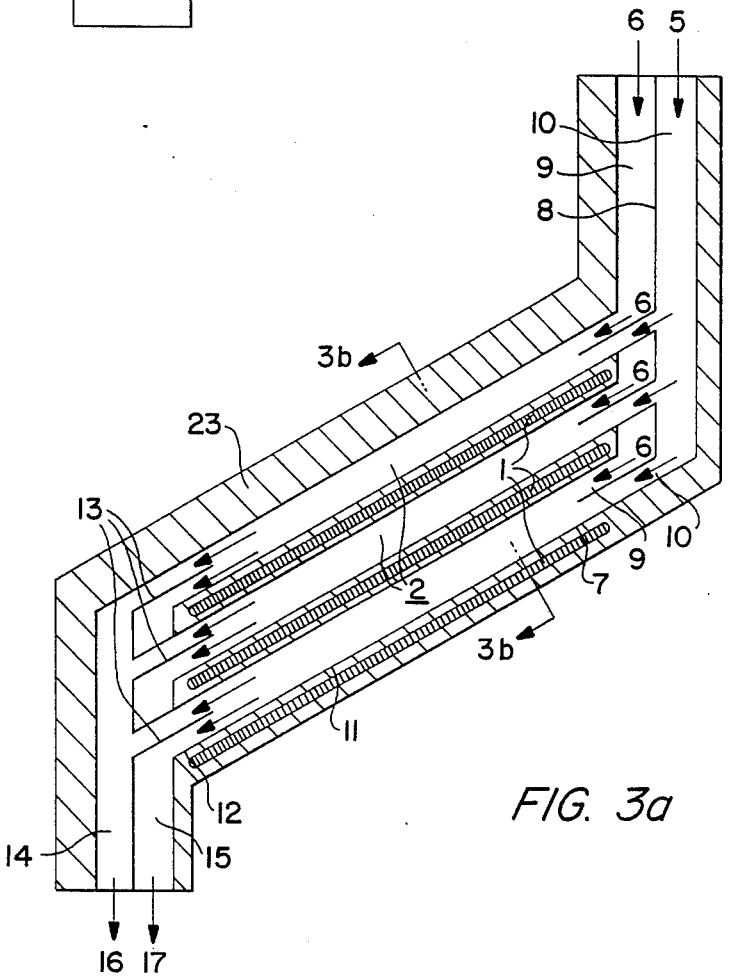
Figure 4:
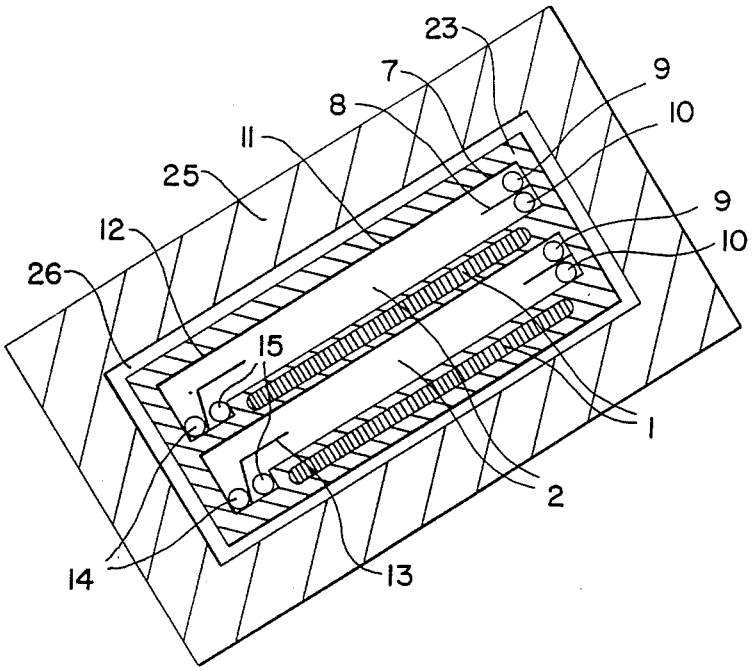
Figure 5A:
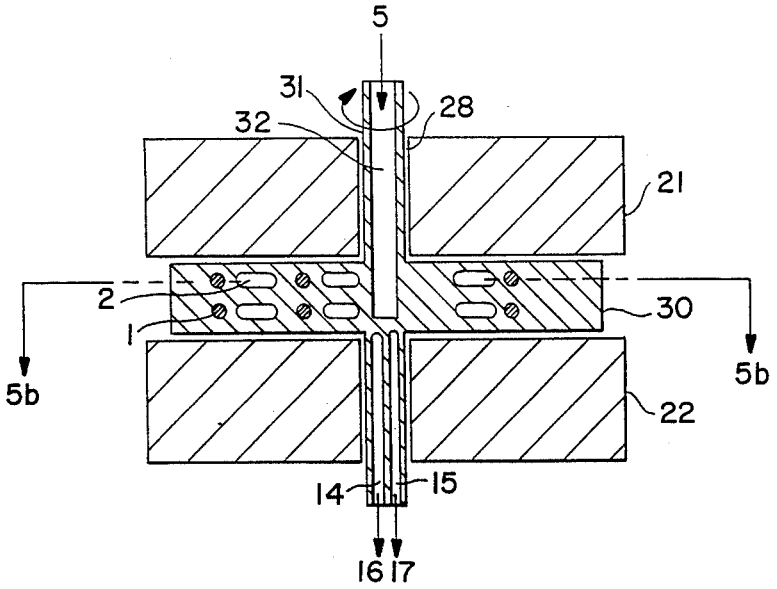
Figure 5B:
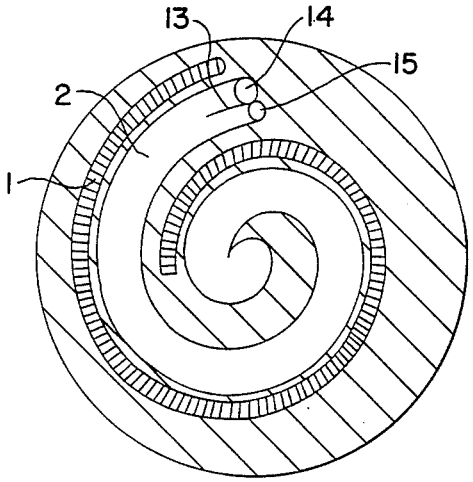
Figure 6:
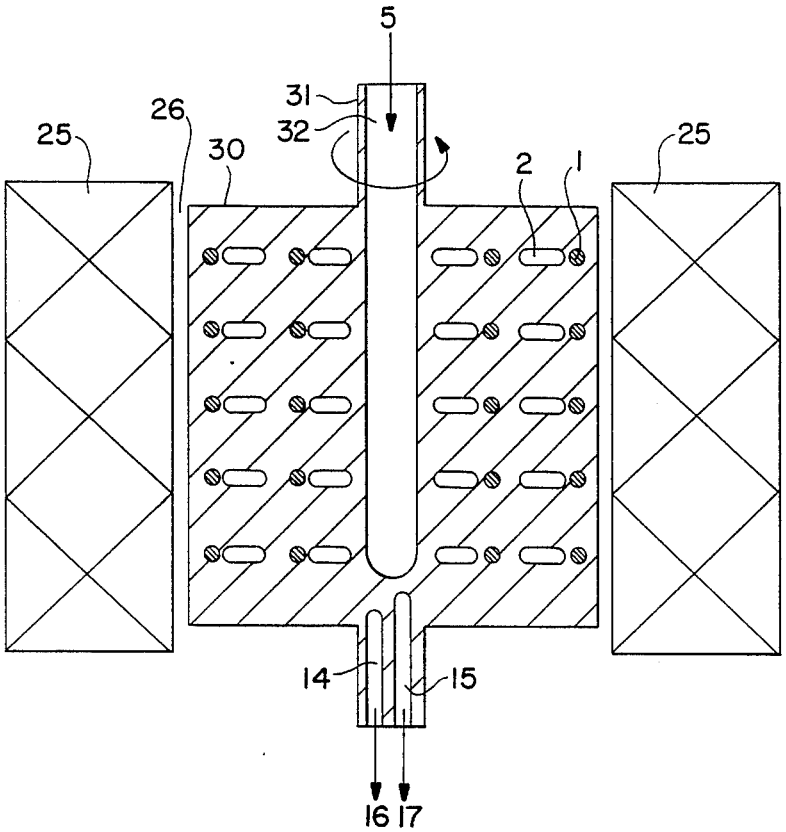

FIGS. 3*a* and 3*b* are longitudinal and cross sectional elevations, respectively, of a magnetic separator comprising stationary, straight, inclined induction members and separating channels between the poles of a permanent magnet or an electromagnet;

FIG. 4 shows a magnetic separator comprising stationary, straight, inclined induction members and separating channels in a superconductive coil;

FIGS. 5*a* and 5*b* are longitudinal and cross sectional elevations, respectively, of a magnetic separator comprising an assembly of spiral induction members and separating channels in a rotor which revolves between the poles of a permanent magnet or an electromagnet; and FIG. 6 shows a magnetic separator comprising an assembly of spiral induction members and separating channels in a rotor revolving in a superconductive coil.

In the embodiment according to FIG. 3 which shows a high-intensity magnetic repulsion separator for separation in the gravitational field the magnet which may be a permanent magnet or, preferably, an electromagnet is aligned such that the lines of flux extend horizontally. A body 23 including a separating system of wire-like induction members 1 and separating channels 2 disposed above the same is located between pole shoes 21 and 22. The induction members, although being at right angles with respect to the lines of flux, are inclined with respect to the horizontal by an angle of from 15° to 40°. In each separating channel 2 the feed flow 5, generally material to be separated which is suspended in water, is introduced at the inlet end 7 below a partition 8 through the lower inlet passage 10. Above the partition 8, a fluid flow 6 which is free of material to be separated, in general clean water, is fed through the upper inlet passage 9. At the outlet end 12 of each separating channel 2, but still within the magnetic field, there is the separator blade 13 which divides the stream into an upper product flow 16 containing the magnetic concentrate and a lower product flow 17 containing the unmagnetic material. These product flows are withdrawn through the outlet passages 14 and 15, respectively. A first system of passages (not shown) at the inlet end 7 of the separating system distributes the feed flow 5 and the fluid flow 6 to the separating passages 2; a second system of passages (likewise not shown) at the outlet end 12 on the one hand combines the upper product flows 16 and on the other hand the lower product flows 17.

FIG. 4 shows a high-intensity magnetic repulsion separator for separation in the gravitational field in a superconductive coil 25. A superconductive coil 25 has a rectangular, warm opening 26. The coil is arranged such that the lines of flux which are directed axially in the interior of the coil extend horizontally and the longer edge of the rectangular, warm opening 26 is inclined with respect to the horizontal by an angle of between 15° and 40°. The separating system is located in the warm opening 26. The induction members 1 and separating channels 2 are oriented at right angles with respect to the lines of flux and parallel to the longer edge. As with the magnetic separator shown in FIG. 3, a feed flow 5 is supplied through inlet passages 10 to the lower end of each separating channel 2 and a stream of water separated from the feed flow by a partition 8 is supplied through inlet passages 9 at the upper end. At the outlet end 12 two product flows, separated from each other by a separator blade 13 are withdrawn through outlet passages 16 and 17. The distribution of the entire feed flow of material to be separated and of the entire stream of water to the separating channels 2 is effected in the same manner by a system of passages, just like the upper and lower product flows from the outlet passages 16 and 17 of each separating channel are combined by such a system.

FIG. 5 shows a high-intensity magnetic repulsion separator for separation in the centrifugal field, comprising a permanent or electromagnet arrangement. Between pole shoes 21 and 22 of a magnet formed with a central bore 28 a rotor 30 is supported with its shaft 31 aligned in parallel with the lines of flux. The magnet preferably is mounted in such manner that the lines of flux extend vertically. In the rotor 30 a plurality of induction members 1 and separating channels 2 are formed so as to lead spirally from the inside to the outside. The separating channels 2 are located at the inside of the induction members 1 facing the axis of rotation. The feed flow 5 of material to be separated is fed through a single inlet passage 32 in the upper part of shaft 31 and distributed to the separating channels 2 of rotor 30 by a system of passages (not shown). The upper product flows and the lower product flows from the separating channels 2 are combined by a system of passages (likewise not shown) and discharged through two outlet passages 16 and 17 in the lower part of the shaft 31 of rotor 30.

The high-intensity magnetic repulsion separator for separation in the centrifugal field as shown in FIG. 4 comprises a superconductive coil. A rotor 30 revolves in the warm, circular opening 26 thereof. The axis of rotation of shaft 31 coincides with the axis of the coil. The induction members 1 and separating channels 2 of rotor 30 extend concentrically with respect to the axis of rotation in planes which are perpendicular to the axis of rotation. The feed flow 5 of material to be separated is supplied through an inlet passage 32 in the upper part of the shaft 1 and distributed to the separating channels 2 by a system of passages (not shown). The respective upper and lower product flows each are combined as such and removed through two outlet passages 16 and 17 in the lower part of the rotor shaft.

What is claimed is:

1. An apparatus for the continuous separation of a fluid medium entraining paramagnetic particles and non-paramagnetic particles into two product streams, a first product stream containing substantially all of the paramagnetic particles inlet to the apparatus, and the second product stream containing substantially none of the paramagnetic particles inlet to the apparatus, comprising:

a magnetic field generating means for generating a horizontally homogeneous magnetic field, an induction member located within the homogeneous magnetic field generated by the magnetic field generating means and oriented horizontally at right-angles relative to the magnetic field flux, a separating channel associated with and located above said induction member with respect to the direction of the earth's gravitational force and parallel to said induction member, including an inlet end for receiving fluid medium containing entrained paramagnetic particles, and an outlet end having two outlets, a first outlet suitable for withdrawing the first product stream containing substantially all of the paramagnetic particles inlet to the separating channel, and a second outlet suitable for withdrawing the second product stream containing substantially none of the paramagnetic particles inlet to the separating channel.

2. The apparatus according to claim 1 wherein the induction member has a cross section shape selected from the group comprising: circular, elliptical, rhomboidal.

3. The apparatus according to claim 1, wherein the ratio of the distance between the sides of said separating channel and the distance between the top and bottom of said separating channel is between 1:1 and 1:3.

4. The apparatus according to claim 1 wherein the magnetic field generating means is a superconductive coil.

5. An apparatus for the continuous separation of a fluid medium entraining paramagnetic particles and non-paramagnetic particles into two product streams, a first product stream containing substantially all of the paramagnetic particles inlet to the apparatus, and the second product stream containing substantially none of the paramagnetic particles inlet to the apparatus, comprising:

a magnetic field generating means for generating a homogeneous magnetic field, and a rotor comprising;

an induction member located within the homogeneous magnetic field generated by the magnetic field generating means and oriented at right-angles relative to the magnetic field flux, and concentrically oriented in a plane perpendicular to the axis of rotation of the rotor, a separating channel associated with the induction member and concentrically oriented to be coplanar with, and nearer to the axis of rotation of the rotor and parallel to said induction member, including an inlet end for receiving fluid medium containing entrained paramagnetic particles, and an outlet end having two outlets, a first outlet suitable for withdrawing the first product stream containing substantially all of the paramagnetic particles inlet to the separating channel, and a second outlet suitable for withdrawing the second product stream containing substantially none of the paramagnetic particles inlet to the separating channel.

6. The apparatus according to claim 5 wherein the induction member has a cross section shape selected from the group comprising: circular, elliptical, rhomboidal.

7. The apparatus according to claim 5 which further comprises:

a separator blade disposed between the two outlets of the separating channel.

8. The apparatus according to claim 5 wherein the ratio of the distance between the sides of said separating channel and the distance between the top and bottom of said separating channel is between 1:1 and 1:3.

9. The apparatus according to claim 5 wherein the magnetic field generating means is a superconductive coil.

10. The apparatus as claimed in one of claims 1 or 5, wherein a plurality of induction members and associated separating channels are disposed in the magnetic field of the magnetic field generating means.

11. The apparatus as claimed in claim 10, wherein the plurality of the induction members and associated separating channels are disposed so that a cross section represents a rectangular pattern.

12. The apparatus as claimed in claim 10, wherein the plurality of the induction members and associated separating channels are disposed so that a cross section represents a rhomboid pattern.

13. A method for continuously separating a fluid medium entraining paramagnetic particles and non-paramagnetic particles into two product streams, a first product stream containing substantially all of the paramagnetic particles inlet to the apparatus, and the second product stream containing substantially none of the paramagnetic particles inlet to the apparatus, comprising the steps of:

providing a magnetic field generating means for generating a homogeneous magnetic field with a horizontal magnetic flux, locating an induction member means within the homogeneous magnetic field generated by the magnetic field generating means and oriented horizontally at right angles relative to the magnetic field flux, operatively associating and locating a separating channel means relative to said induction member means in an opposite direction from the direction of an inertial force and parallel to said induction member means, including an inlet end for receiving fluid medium containing entrained paramagnetic particles, and an outlet end having two outlets, a first outlet suitable for withdrawing the first product stream containing substantially all of the paramagnetic particles inlet to the separating channel means, and a second outlet suitable for withdrawing the second product stream containing substantially none of the paramagnetic particles inlet to the separating channel means, providing a flow of said fluid medium to the inlet of the separating channel means, energizing the said magnetic field generating means so as to induce a non-homogeneous magnetic field within the separating channel means to induce and separate the paramagnetic particles from the non-paramagnetic particles entrained in the fluid medium by counterbalancing said inertial force effects acting upon the paramagnetic particles and simultaneously not counteracting the inertial force effects upon the non-paramagnetic particles.

14. The method according to claim 13 wherein the inertial force effects are the gravitational attraction of the earth.

15. The method according to claim 13 wherein the inertial force effects are centrifugal forces.

* * * * *